United States Patent [19]

Callihan et al.

[11] 4,442,894

[45] Apr. 17, 1984

[54] UNITARY FLOAT VALVE AND WIPING PLUG RETAINER

[75] Inventors: Rudy B. Callihan, San Antonio; Clyde Wainwright, McQueeney, both of Tex.

[73] Assignee: Baker Oil Tools, Inc., Orange, Calif.

[21] Appl. No.: 385,615

[22] Filed: Jun. 7, 1982

[51] Int. Cl.[3] ..... E21B 33/14

[52] U.S. Cl. ..... 166/156; 166/328; 166/386

[58] Field of Search ..... 166/154, 156, 327, 328, 166/374, 383, 386

[56] References Cited

U.S. PATENT DOCUMENTS

| | | | |
|---|---|---|---|
| 2,196,652 | 4/1940 | Baker | 166/156 |
| 2,621,742 | 12/1952 | Brown | 166/156 |
| 2,874,785 | 2/1959 | Muse | 166/328 |
| 3,006,415 | 10/1961 | Burns et al. | 166/156 |
| 4,060,131 | 11/1977 | Kenneday et al. | 166/156 |

*Primary Examiner*—Stephen J. Novosad
*Assistant Examiner*—William P. Neuder
*Attorney, Agent, or Firm*—Norvell & Associates

[57] ABSTRACT

A cementing float valve for subterranean wells is provided wherein a wiping plug retaining sleeve is concentrically positioned on the top of a float valve and secured to an outer housing by cementitous or other drillable material. the retaining sleeve provides a downwardly facing latching surface and a seal bore disposed above the latching surface for cooperation respectively with an expandable ring and an annular seal conventionally provided on a wiping plug.

2 Claims, 3 Drawing Figures

UNITARY FLOAT VALVE AND WIPING PLUG RETAINER

BACKGROUND OF THE INVENTION

1. Field of the Invention

The invention relates to the unitary construction of a float valve and a latch sleeve for retaining a wiping plug in its final sealed position adjacent the float valve following the conclusion of a well cementing operation.

2. Description of the Prior Art

The great majority of subterranean wells have the bottom end of the casing anchored in the well bore by a poured in place annulus of cement. Additionally, those wells employing liners which extend below the well casing also employ cement to anchor the bottom portions of the liner in the well bore. In either event, whether a casing or liner is to be cemented in the well bore, it is conventional to provide a cement float valve in the bottom portions of the casing or liner to permit the unidirectional flow of cement slurry downwardly through the valve and out of the casing or liner, and prevent reverse flow of the applied slurry into the casing or liner.

The next step commonly employed is to run a wiping plug, having elastomeric flanges on its periphery, down through the casing or liner to remove the cementitous material from the interior walls and also to provide a seal above the float valve to prevent entry of drilling mud or other well fluids into the region occupied by the float valve.

In the prior art devices, a lock sleeve or collar was threaded into the interior of the casing or liner coupling which is positioned immediately above the location of the float valve. Such lock sleeve engaged an expandable ring on the wiping plug to prevent its upward movement from its sealing position. Such lock sleeve threadably engaged the interior threads provided in the coupling at their central portion and attempted to effectuate a seal with the bottom casing or liner member to which the coupling was applied, by compressing an annular mass of rubber or other elastomeric material against the upstanding end of the liner or casing and into the threads of the coupling (See FIG. 1). As is known to those skilled in the art, the central threaded portion of a standard coupling has no specifications applicable to the threads at that location. More importantly, the upwardly facing end of the casing or liner is devoid of any specifications and can have any configuration. As a result, it has been recognized that the field assembled seal effected between the lock sleeve and the upstanding end of the casing or liner section to which the coupling is applied has not been effective and has resulted in leakage in a great many instances. Such leakage has previously not been considered a serious matter since the well could have one or more float valves disposed below the lock sleeve and, so long as those float valves achieved a seal, there would be no passage for cementitous or other fluids to rise upwardly through the improperly sealed lock sleeve. Modern wells involving extreme depths, pressures and temperatures cannot tolerate any possibility of leakage around any component.

SUMMARY OF THE INVENTION

This invention provides a improved cementing float valve which is preassembled at the factory or the offsite location to precisely and rigidly mount within a common tubular housing a cementing float valve and a latching sleeve disposed immediately above the float valve. The latching sleeve defines a downwardly facing latching surface which is engageable by a snap ring conventionally carried on the bottom end of a wiper plug. The latching sleeve further defines a seal bore above the latching shoulder for cooperation with an annular external sealing element carried by the wiping plug. Thus the sealed assemblage of the latching sleeve within the tubular conduit of the well is assured, as well as proper sealing engagement achieved in the field between the annular sealing element carried by the wiper plug and the seal bore surface defined by the latching sleeve.

The float valve construction embodying this invention in no manner interferes with the operation of the float valve, which may be of any conventional type, but preferably is of the vertically shiftable ball type, incorporating an annular sealing surface above the ball in order to permit only downward flow of cementing fluid through the float valve.

BREIF DESCRIPTION OF THE DRAWINGS

DESCRIPTION OF THE PREFERRED EMBODIMENT

Figure 1:
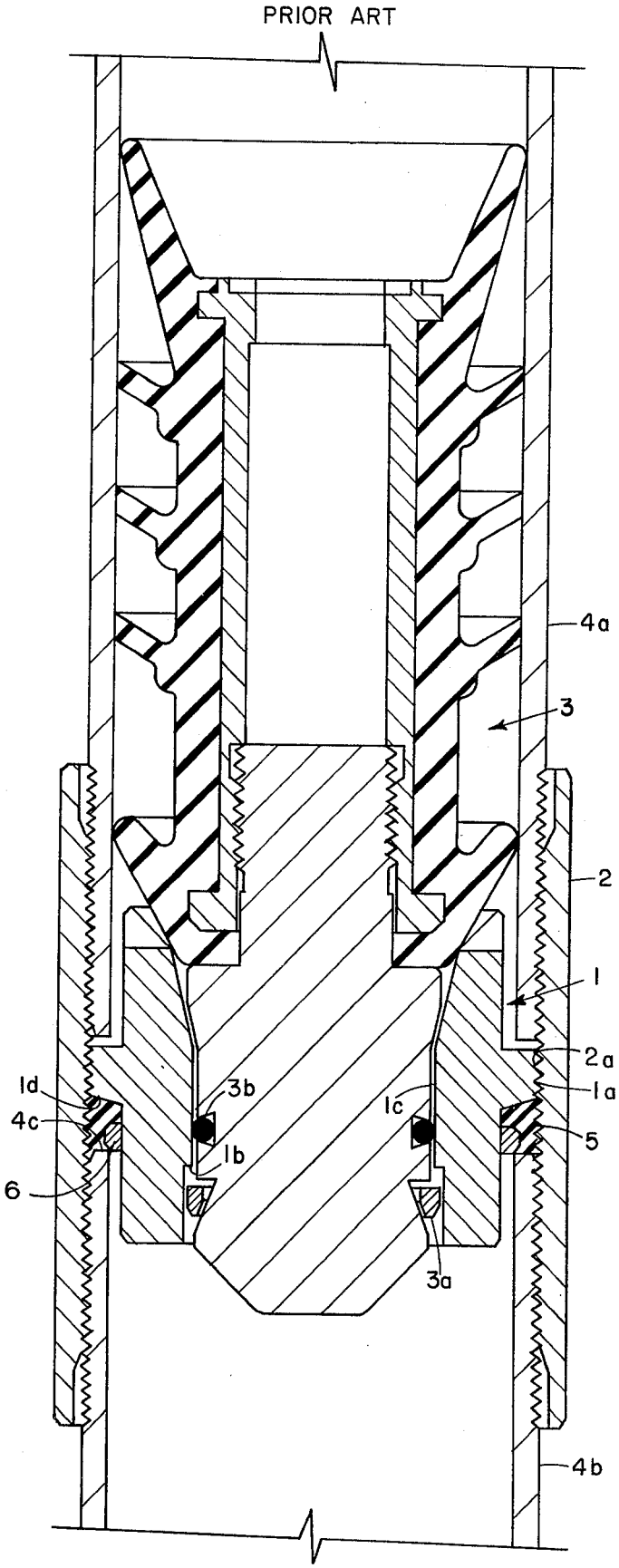
FIG. 1 is a vertical sectional view of a wiping plug and a plug latching collar mounted in accordance with the prior art practice in the center of a coupling sleeve.

Referring to FIG. 1, a prior art latching collar is shown for securing a wiping plug in a latched position at the bottom of a well immediately after the application of cementing fluid to the well is shown. Such apparatus includes a collar 1 having a relatively short externally threaded section 1*a* which threadably engages the central threaded portions 2*a* of a conventional pipe coupling 2. Collar 1 further includes a downwardly facing, internal latching shoulder 1*b*, which cooperates with a snap ring 3*a* on a conventional wiping plug 3, and a seal bore 1*c* which is designed to cooperate with an external annular elastomeric seal 3*b* provided on the wiping plug 3.

As is well known to those skilled in the art, the central threaded portions 2*a* of the coupling sleeve have no specifications applicable thereto and hence no seal is provided by the threaded engagement of the threads 1*a* on the collar 1 with the coupling thread portions 2*a*. Furthermore, these cooperating threads are relatively rough and are only loosely engaged so that it is quite possible for the collar 1 to be mounted in a cocked or non-concentric position relative to the axis of the well conduit represented by the pipe sections 4*a* and 4*b*, particularly when the assembly is made in the field.

To overcome the lack of sealing connection between the threads 1*a* and 2*a*, the prior art devices incorporated an annular mass 5 of elastomeric material which is disposed between a downwardly facing external surface 1*d* provided on the collar 1 and the upwardly facing end surface 4*c* of the lower pipe section 4*b*. A press fitted ring 6 secures the annular mass 5 on the wiping plug 3. Again, as is well known to those skilled in the art, there are no specifications whatsoever applicable to the configuration or of dimensions of the end surface 4c of the pipe 4b, hence, the possibility of achieving a good seal by compressing the annular elastomeric mass 5 is problematical at best. Similarly, if the latching collar 1 is actually angularly cocked in its position within the coupling 2, there is the distinct possibility that no seal will be obtained between the seal bore 1c and the annular sealing ring 3b provided on the wiping plug 3. These known deficiencies of prior art constructions have been heretofore more or less overlooked or tolerated, due to the fact that reliance was placed on the effectiveness of the seal achieved by one or more float valves disposed below the location of the latching sleeve 2. In modern wells, where extreme drilling depths, pressures and temperatures are encountered, such possibility of leakage can no longer be tolerated.

Figure 2:
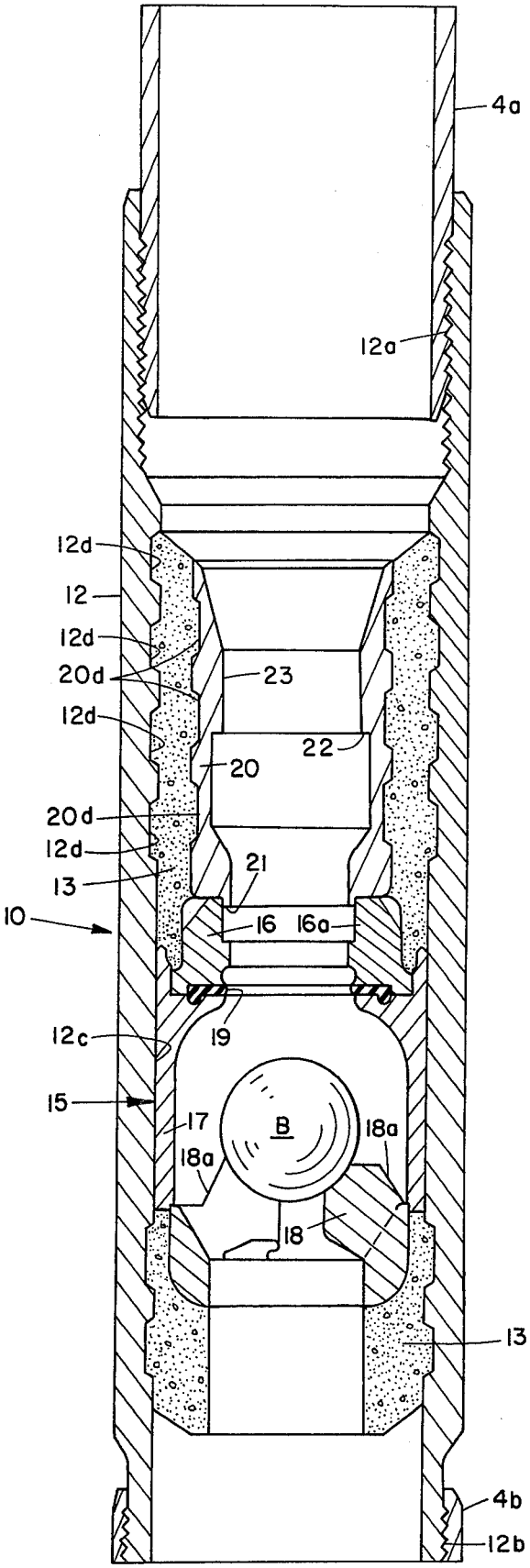
FIG. 2 is a vertical sectional view of a float valve construction incorporating this invention shown with the elements thereof in the position occupied during passage of cementing fluid through the valve.
Figure 3:
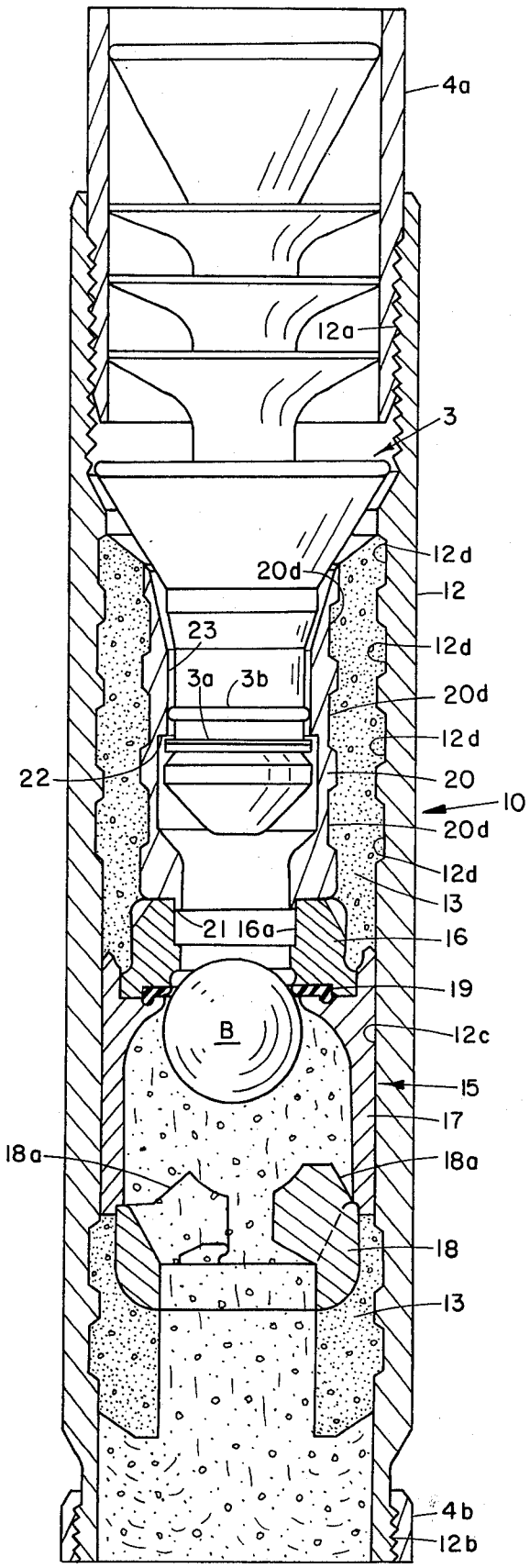
FIG. 3 is a view similar to FIG. 2 but showing the elements of the valve after the application of cementing fluid to the well and following the insertion of a wiping plug through the well conduit to achieve a latched engagement with the float valve unit.

Referring now to FIGS. 2 and 3 there is shown a cementing float valve 10 embodying this invention. Valve 10 includes a tubular outer housing 12 which has its opposite ends internally and externally threaded, as indicated at 12a and 12b, for attachment to pipe sections 4a and 4b. Such pipe sections may comprise either the well casing or the well liner.

Within the tubular housing 12 a unidirectional flow valve unit 15 is mounted. Such unit includes an annular housing assemblage comprising an upper housing part 16, a cylindrical center body part 17 and a lower part 18. Center body part 17 is snugly engaged in the bore 12c of outer housing 12. An elastomeric annular sealing element 19 is provided between the upper housing part 16 and the medial housing part 17 to provide a ball seat. The bottom housing part 18 is provided with a plurality of peripherally spaced, upwardly projecting support lugs 18a on which a ball B is normally supported, permitting cementing fluid to pass freely around the ball and through the valve. Upon any reversal of the cement flow, such as inherently occurs at the termination of the cementing operation, the ball B rises into sealing engagement with the annular elastomeric sealing element 19 and effects a sealed barrier to such reverse flow, as shown in FIG. 3. Those skilled in the art will recognize that the ball valve illustrated is only one of a substantial number of well known types of unidirectional flow valves that may be employed within the tubular housing 12.

Immediately above the upper valve housing element 16, a latching sleeve 20 is mounted. Latching sleeve 20 is provided with a depending annular projection 21 which snugly engages the bore 16a of the uppermost valve housing element 16, thereby assuring the axial alignment of the latching sleeve 20 with the axis of the tubular housing 12. Sleeve 20 further defines a downwardly facing, annular, internal latching shoulder 22. Immediately above shoulder 22, sleeve 20 is provided with a seal bore surface 23. As best shown in FIG. 3, the latching surface 22 cooperates with the C-ring 3a conventionally carried on the bottom portion of the conventional wiper plug 3, and the seal bore surface 23 cooperates in sealing relationship with the annular elastomeric seal 3b carried by such wiping plug at a position immediately above the C-ring 3a.

The entire assemblage of the valve unit 15 and the latching sleeve 20 is precisely, rigidly and sealably effected within the housing 12 at the factory through the application of cementitous material 13 to the annular space defined between the sleeve 20 and the bore 12c of the tubular housing 12 and the exterior of the bottom housing element 18 and the bore 12c. To assist in the anchoring of the cementitous material 13, the bore 12c of tubular housing 12 is preferably provided with a series of vertically spaced, peripheral grooves 12d. Similar grooves 20d may be provided on the exterior of the latching sleeve 20.

In any event, the entire assemblage is accomplished at the factory, not in the field, and the precise alignment of the axis of the latching sleeve 20 with the axis of the tubular housing 10 is assured. Furthermore, leakage around sleeve 20 is eliminated. Hence, when the wiping plug 3 is dropped into engagement with the latching sleeve 20, there is no problem of cocking of the sleeve 20 relative to the axis of the housing 12 and a good reliable seal is achieved between the seal bore surface 22 of the latching sleeve 20 and the annular elastomeric seal 3b provided on the wiping plug 3.

Those skilled in the art will recognize that all of the components disposed interiorly of the bore of housing 12 will be fabricated from drillable materials in order to permit drilling through the valve unit 15 and latching sleeve 20 in the event that further operations are required in the well below the location of the tubular housing 12.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A drillable cementing float valve for subterranean wells comprising: a tubular housing; means on at least one end of said housing for connection of a well conduit; a unidirectional flow valve unit having an annular housing assemblage including a cylindrical portion snugly fitting within the bore of said tubular housing and operable to permit only downward flow of cementing fluid; a sleeve mounted in said tubular housing above said valve unit; said sleeve having a depending annular flange extending into the bore of said annular housing assemblage and engagable therewith to maintain the concentricity of the sleeve with the axis of said tubular housing; means in said sleeve defining a downwardly facing, latching shoulder; and means for rigidly securing said valve unit and said sleeve within said tubular housing, whereby a conduit wiping plug may be sealingly latched to said downwardly facing latching shoulder to resist movement in one direction, said wiping plug being sealingly engaged with the bore of said sleeve.

2. The cementing float valve of claim 1 wherein said means for securing said valve unit comprises an annular layer of cementitous material surrounding portions of said valve unit and said sleeve and anchored to the bore of said tubular housing.

* * * * *